US011705662B2

(12) United States Patent
Song et al.

(10) Patent No.: US 11,705,662 B2
(45) Date of Patent: Jul. 18, 2023

(54) CONNECTOR AND CONNECTOR ASSEMBLY

(71) Applicant: Dongguan Luxshare Technologies Co., Ltd, Dongguan (CN)

(72) Inventors: Tao Song, Dongguan (CN); Kun Liu, Dongguan (CN); RongZhe Guo, Dongguan (CN); KaiDe Wang, Dongguan (CN); JinChuang Lan, Dongguan (CN)

(73) Assignee: Dongguan Luxshare Technologies Co., Ltd., Dongguan (CN)

( * ) Notice: Subject to any disclaimer, the term of this patent is extended or adjusted under 35 U.S.C. 154(b) by 79 days.

(21) Appl. No.: 17/495,223

(22) Filed: Oct. 6, 2021

(65) Prior Publication Data

US 2022/0190507 A1 Jun. 16, 2022

(30) Foreign Application Priority Data

Dec. 11, 2020 (CN) ..... 202011451270.6

(51) Int. Cl.
*H01R 13/514* (2006.01)
*H01R 12/72* (2011.01)
(Continued)

(52) U.S. Cl.
CPC ..... *H01R 13/514* (2013.01); *H01R 12/72* (2013.01); *H01R 13/629* (2013.01); *H01R 13/639* (2013.01)

(58) Field of Classification Search
CPC . H01R 13/514; H01R 13/629; H01R 13/6273
See application file for complete search history.

(56) References Cited

U.S. PATENT DOCUMENTS 4,556,270 A * 12/1985 Schutzle ..... H01R 13/62 439/492
5,277,627 A * 1/1994 Matsuzaki ..... H01R 13/64 439/353

(Continued)

FOREIGN PATENT DOCUMENTS

CN 2280369 Y 4/1998
CN 103259133 A 8/2013

(Continued)

*Primary Examiner* — Neil Abrams
(74) *Attorney, Agent, or Firm* — Birch, Steward, Kolasch & Birch, LLP

(57) ABSTRACT

The present disclosure provides a connector and a connector assembly. The connector includes a plurality of guiding blocks and at least one connection port. Each of the plurality of guiding blocks has a first surface, a second surface opposite to the first surface, and a third surface adjacent to the first surface and the second surface. A first guiding groove is disposed on the first surface. A second guiding groove is disposed on the second surface. An engaging hole is inserted between the first guiding groove and the second guiding groove. A locking hole is disposed on the third surface. Each of the at least one connection port is disposed on two adjacent guiding blocks of the plurality of guiding blocks. The connector may be used with a mating connector having fixing bars to engage in the guiding grooves or alternatively with a mating connector having locking pieces to engage in the locking holes.

10 Claims, 9 Drawing Sheets

(51) Int. Cl.
*H01R 13/629* (2006.01)
*H01R 13/639* (2006.01)

(56) References Cited

U.S. PATENT DOCUMENTS

| | | | | | |
|---|---|---|---|---|---|
| 5,569,047 | A * | 10/1996 | Pauza | H01R 13/633 | 439/353 |
| 5,795,174 | A | 8/1998 | Saito et al. | | |
| 6,113,415 | A * | 9/2000 | Bertsch | H01R 13/514 | 439/701 |
| 6,146,210 | A * | 11/2000 | Cha | H01R 13/642 | 439/353 |
| 7,285,005 | B2 * | 10/2007 | Gabrielsson | H01R 13/6278 | 439/378 |
| 11,563,289 | B2 * | 1/2023 | Chen | H01R 13/516 | |
| 2015/0086171 | A1 * | 3/2015 | Tuey | G02B 6/3893 | 385/139 |
| 2017/0187139 | A1 * | 6/2017 | Dekoski | H01R 13/62933 | |
| 2019/0386432 | A1 | 12/2019 | Aoshima | | |
| 2022/0190507 | A1 * | 6/2022 | Song | H01R 13/631 | |

FOREIGN PATENT DOCUMENTS

| | | | |
|---|---|---|---|
| CN | 103872510 | A | 6/2014 |
| CN | 106486805 | A | 3/2017 |
| CN | 109167203 | A | 1/2019 |
| CN | 110165448 | A | 8/2019 |
| JP | 10-29600 | A | 2/1998 |
| JP | 11-214071 | A | 8/1999 |
| WO | WO 2016/033996 | A1 | 3/2016 |

* cited by examiner

CONNECTOR AND CONNECTOR ASSEMBLY

CROSS REFERENCE TO RELATED DISCLOSURE

This application claims the priority benefit of Chinese Patent Application Number CN202011451270.6, filed on Dec. 11, 2020, the full disclosure of which is incorporated herein by reference.

BACKGROUND

Technical Field

The present disclosure relates to the technical field of connecting port, particularly to a connector and a connector assembly.

Related Art

In electronic products, two electronic devices may exchange signals with a transmission line through a connector. For example, the connector may have a signal port for transmitting image data, or the connector may also have a network port for connecting to the internet. However, as the amount of transmitted information increases, the shapes of connection port and transmission line become more and more complicated. Therefore, the connection port and the transmission line have a specific plugging direction for plugging. Furthermore, the connector and/or the transmission line may be worn or damaged due to plugging process with excessive force or skewed direction.

In addition, in some cases, the connector and the transmission line may be fixed by screw locking. In other cases, the connector and the transmission line may also be fixed by engaging. Therefore, the connector is usually provided with multiple connection ports. The multiple connection ports have different connection elements (for example, engaging holes or locking hole) to be applied to transmission end of different fixing methods. However, the design of multiple connection ports corresponding to transmission ends of different fixed modes cannot effectively use space, resulting in low space utilization.

SUMMARY

The embodiments of the present disclosure disclose a connector and a connector assembly, in order to solve the problem of plugging unsmoothly between the current connector and the transmission line and the problem of connection port only having one fixing method in the connector.

In order to solve the above technical problems, the present disclosure is implemented as follows.

In the first aspect, the present disclosure provides a connector including a plurality of guiding blocks and at least one connection port. Each of the plurality of guiding blocks has a first surface, a second surface opposite to the first surface, and a third surface adjacent to the first surface and the second surface. A first guiding groove is disposed on the first surface. A second guiding groove is disposed on the second surface. An engaging hole is inserted between the first guiding groove and the second guiding groove. A locking hole is disposed on the third surface. Each of the at least one connection port is disposed on two adjacent guiding blocks of the plurality of guiding blocks. One side of each of the at least one connection port faces the first surface of one of the plurality of guiding blocks, and the other side of each of the at least one connection port faces the second surface of another of the plurality of guiding blocks.

In the second aspect, the present disclosure provides a connector assembly including a circuit board, a first connector, and a second connector. The first connector electrically connected to the circuit board, and the first connector includes a plurality of guiding blocks and at least one connection port. Each of the plurality of guiding blocks has a first surface, a second surface opposite to the first surface, and a third surface adjacent to the first surface and the second surface. A first guiding groove is disposed on the first surface. A second guiding groove is disposed on the second surface. An engaging hole is inserted between the first guiding groove and the second guiding groove. A locking hole is disposed on the third surface. Each of the at least one connection port is disposed on two adjacent guiding blocks of the plurality of guiding blocks. One side of each of the at least one connection port faces the first surface of one of the plurality of guiding blocks, and the other side of each of the at least one connection port faces the second surface of another of the plurality of guiding blocks. The second connector detachably connected to one of the at least one connection port of the first connector, and the second connector includes a fixing piece. The fixing piece has two fixing bars. The two fixing bars are respectively located on both sides of the fixing piece, and the two fixing bars respectively correspond to the first guiding groove and the second guiding groove.

In the third aspect, the present disclosure provides a connector assembly including a circuit board, a first connector, and a second connector. The first connector electrically connected to the circuit board, and the first connector includes a plurality of guiding blocks and at least one connection port. Each of the plurality of guiding blocks has a first surface, a second surface opposite to the first surface, and a third surface adjacent to the first surface and the second surface. A first guiding groove is disposed on the first surface. A second guiding groove is disposed on the second surface. An engaging hole is inserted between the first guiding groove and the second guiding groove. A locking hole is disposed on the third surface. Each of the at least one connection port is disposed on two adjacent guiding blocks of the plurality of guiding blocks. One side of each of the at least one connection port faces the first surface of one of the plurality of guiding blocks, and the other side of each of the at least one connection port faces the second surface of another of the plurality of guiding blocks. The second connector detachably connected to one of the at least one connection port of the first connector, and the second connector includes at least two locking pieces. The at least two locking pieces are respectively located on both sides of the second connector, and the at least two locking pieces respectively correspond to the locking hole.

In the embodiment of the present disclosure, the plugging process of a transmission end may be smooth through the first guide groove and the second guide groove on the guiding block of the connector. In addition, one connection port of the connector may correspond to the transmission end having different fixing methods through an engaging hole and a lock hole, therefore the utilization of space is improved. Further, the number of connection ports with the same function but with different fixing methods of a product may be reduced by having the connector mentioned above, therefore the utilization of space is improved.

BRIEF DESCRIPTION OF THE DRAWINGS

The figures described herein are used to provide a further understanding of the present disclosure and constitute a part of the present disclosure. The exemplary embodiments and descriptions of the present disclosure are used to illustrate the present disclosure and do not limit the present disclosure, in which.

DETAILED DESCRIPTION OF THE EMBODIMENTS

In order to make the objectives, technical solutions, and advantages of the present disclosure clearer, the technical solutions of the present disclosure will be described clearly and completely in conjunction with specific embodiments and the figures of the present disclosure. Obviously, the described embodiments are only a part of the embodiments of the present disclosure, rather than all the embodiments. Based on the embodiments in the present disclosure, all other embodiments obtained by a person of ordinary skill in the art without creative work fall within the protection scope of this disclosure.

The following description is of the best-contemplated mode of carrying out the present disclosure. This description is made for the purpose of illustrating the general principles of the present disclosure and should not be taken in a limiting sense. The scope of the present disclosure is best determined by reference to the appended claims.

Moreover, the terms "include", "contain", and any variation thereof are intended to cover a non-exclusive inclusion. Therefore, a process, method, object, or device that comprises a series of elements not only includes these elements, but also comprises other elements not specified expressly, or may include inherent elements of the process, method, object, or device. If no more limitations are made, an element limited by "include a/an . . . " does not exclude other same elements existing in the process, the method, the article, or the device which comprises the element.

Figure 1:
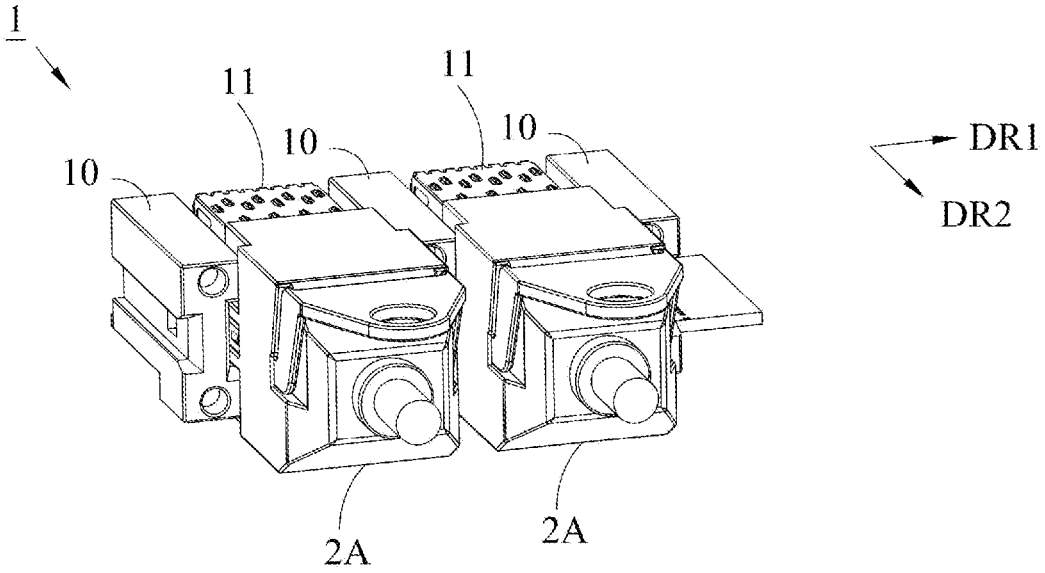
FIG. 1 is a schematic diagram of the first connector according to an embodiment of the present disclosure.
Figure 2:
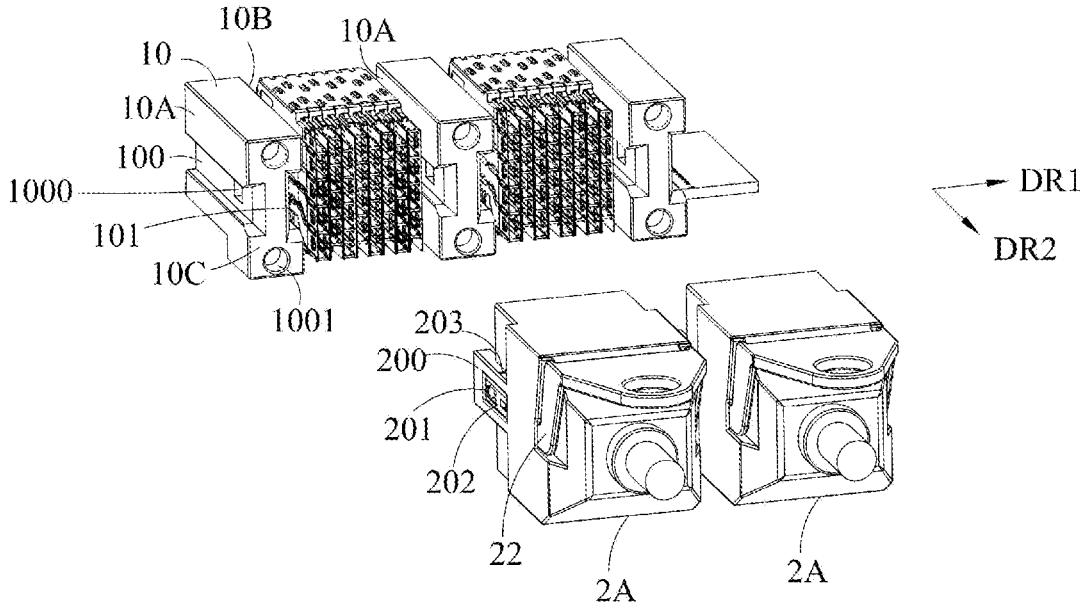
FIG. 2 is an exploded diagram of the first connector according to an embodiment of the present disclosure.
Figure 3:
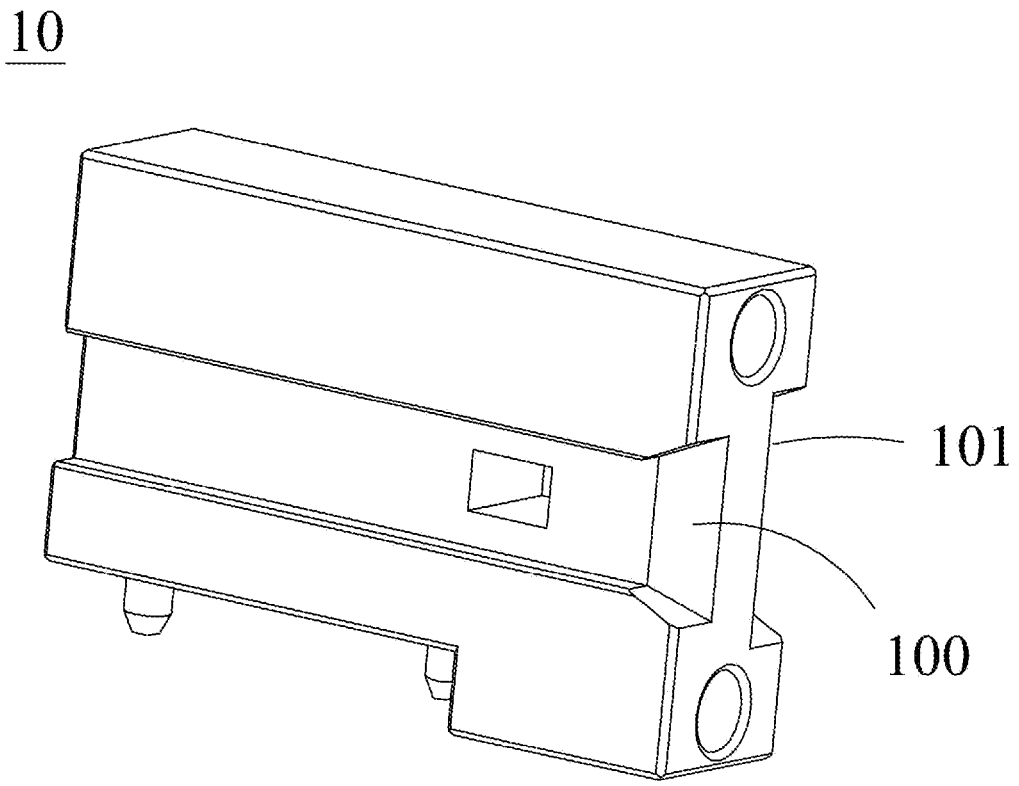
FIG. 3 is a space diagram of the guiding block according to an embodiment of the present disclosure.

FIG. 1 and FIG. 2 are a schematic diagram and an exploded diagram of the connector respectively, and FIG. 3 is a space diagram of the guiding block according to an embodiment of the present disclosure. As shown in the figure, the connector (hereinafter referred to as the first connector 1) is used to connect the transmission end of the transmission line (hereinafter referred to as the second connector 2A). The first connector 1 includes a plurality of guiding blocks 10 and at least one connection port 11. Each of the plurality of guiding blocks 10 has a first surface 10A, a second surface 10B opposite to the first surface 10A, and a third surface 10C adjacent to the first surface 10A and the second surface 10B. A first guiding groove 100 is disposed on the first surface 10A. A second guiding groove 101 is disposed on the second surface 10B. An engaging hole 1000 is inserted between the first guiding groove 100 and the second guiding groove 101. A locking hole 1001 is disposed on the third surface 10C. Each of the at least one connection port 11 is disposed on two adjacent guiding blocks of the plurality of guiding blocks 10. One side of each of the at least one connection port 11 faces the first surface 10A of one of the plurality of guiding blocks 10, and the other side of each of the at least one connection port 11 faces the second surface 10B of another of the plurality of guiding blocks 10.

Specifically, the number of guiding block 10 in the present embodiment is three, the number of connection port 11 is two. The guiding blocks 10 and the connection ports 11 are arranged in sequence. From FIG. 2, the right side of each of the connection ports 11 is the first surface 10A of one guiding block 10. That is, the right side of each of the connection ports 11 is adjacent to the first guiding groove 100. The left side of each of the connection ports 11 is the second surface 10B of another guiding block 10. That is, the left side of each of the connection ports 11 is adjacent to the second guiding groove 101. The first guiding groove 100 and the second guiding groove 101 are disposed to correspond to a fixing bar 200 of the transmission line, therefore connecting between the second connector 2A and the first connector 1 may be accurately positioned. In addition, the engaging hole 1000 inserted through the first guiding groove 100 and the second guiding groove 101 extends along the first direction DR1. The engaging hole 1000 corresponds to an engaging part 201 of the second connector 2A, so that the second connector 2A may be fixed to the first connector 1. In order to make the technical features of the present disclosure more obvious, the relationship between the first guiding groove 100, the second guiding groove 101, the engaging hole 1000, and the second connector 2A will be described in detail hereinafter.

Figure 4:
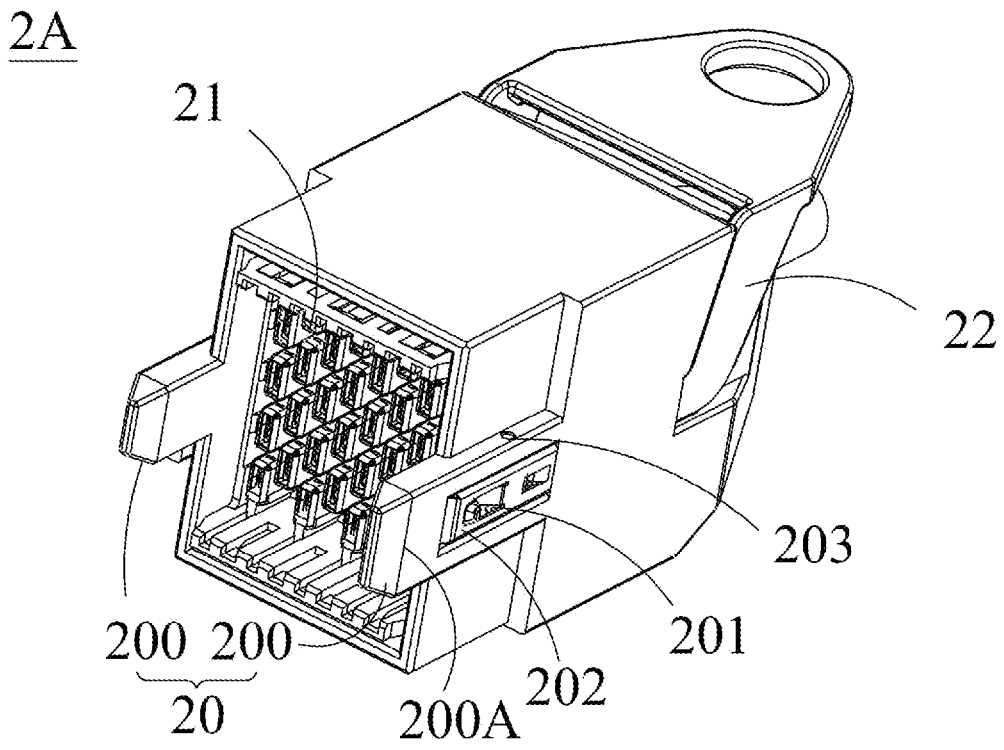
FIG. 4 is a schematic diagram of the second connector of the transmission line according to an embodiment of the present disclosure.

FIG. 4 is a schematic diagram of the second connector of the transmission line according to an embodiment of the present disclosure. As shown in the figure, the second connector 2A may include a fixing piece 20 and a transmission port 21. The fixing piece 20 has two fixing bars 200, and the two fixing bars 200 are respectively disposed on both sides of the fixing piece 20. The two fixing bars 200 respectively correspond to the first guiding groove 100 and the second guiding groove 101 of the first connector 1. In other words, when the second connector 2A is plugged into the connection port 11 of the first connector 1, the two fixing bars 200 move along the first guiding groove 100 and the second guiding groove 101, respectively. That is, the first guiding groove 100 and the second guiding groove 101 are used to guide the plugging process of the second connector 2A, therefore the functions of positioning and guiding are achieved.

In some embodiments, the fixing bar 200 of the second connector 2A may further include the engaging part 201, an engaging plank 202 and a rotating shaft 203. The engaging plank 202 is pivoted on the fixing bar 200 through the rotating shaft 203. The engaging part 201 is disposed on the engaging plank 202, and the engaging part 201 corresponds to the engaging hole 1000. In the case where the above-mentioned elements are disposed, the second connector 2A may further include a pulling piece 22. The pulling piece 22 is movably disposed between the engaging plank 202 and the fixing bar 200. More specifically, when the pulling piece 22 moves toward the end 200A of the fixing bar 200, the space between the engaging plank 202 and the fixing bar 200 will be occupied by the pulling piece 22, so that the engaging plank 202 does not have space to rotate. Therefore, the moving of the engaging plank 202 is limited. Conversely, when the pulling piece 22 moves toward the end 200A opposite to the fixing bar 200, a gap appears between the engaging plank 202 and the fixing bar 200. In this way, the engaging plank 202 may rotate about the rotating shaft 203 as an axis, so as to separate the engaging part 201 from the engaging hole 1000.

That is, when the second connector 2A is connected with the first connector 1, by plugging the pulling piece 22 into the fixing bar 200, the moving of the engaging plank 202 may be limited, and the engaging part 201 and engaging hole 1000 may be fixed to each other. On the other hand, the second connector 2A may be disconnected from the first connector 1 through pulling out of the pulling piece 22 from the fixing bar 200. As a result, the moving of the engaging plank 202 is no longer limited. The engaging part 201 and the engaging hole 1000 on the engaging plank 202 are separated from each other.

It should be noted that although each guide block 10 in FIG. 2 has only one engaging hole (i.e., engaging hole 1000), the present disclosure is not limited thereto. For example, in other embodiments, the engaging hole 1000 of each guide block 10 may include a plurality of sub-engaging holes, and the plurality of sub-engaging holes are disposed at intervals along the second direction DR2. In addition, the engaging part 201 of each fixing bar 200 may include the same number of a plurality of sub-engaging parts, and the plurality of sub-engaging parts are disposed at intervals along the second direction DR2. For example, the number of the plurality of sub-engaging holes and the plurality of sub-engaging parts may be 2, 3, 4, or more than 4, respectively. In this way, the connection strength between the second connector 2A and the first connector 1 is further improved by respectively engaging the plurality of sub-engaging holes and the plurality of sub-engaging parts.

Figure 5:
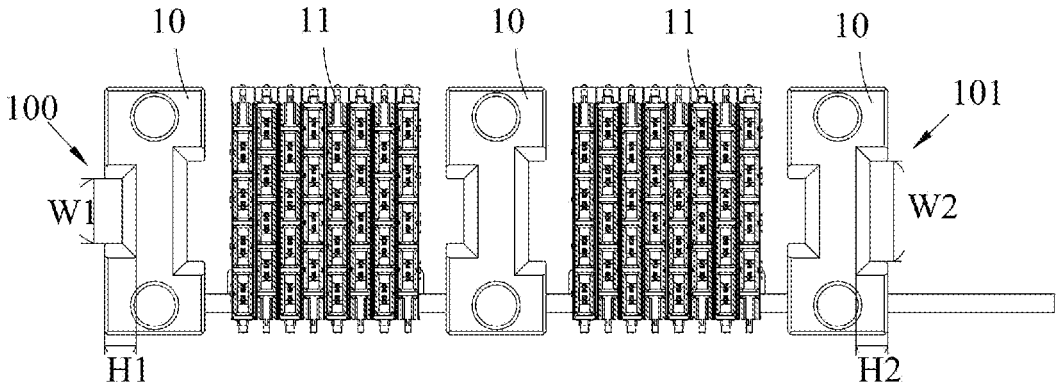
FIG. 5 is a front view of the guiding block according to an embodiment of the present disclosure.

FIG. 5 is a front view of the guiding block according to an embodiment of the present disclosure. As shown in the figure, in some embodiments, the first guiding groove 100 may have a first width W1, and the second guiding groove 101 may have a second width W2. The first width W1 is different from the second width W2. For example, when the transmission port 21 of the second connector 2A and the connection port 11 of the first connector 1 have a specific plugging direction for plugging, the two fixing bars 200 of the second connector 2A may have different widths respectively. Further, the wider fixing bar 200 may correspond to the first guiding groove 100, and the narrower fixing bar 200 may correspond to the second guiding groove 101. When the second connector 2A is plugged into the first connector 1, even the narrower fixing bar 200 may enter the first guiding groove 100 and the second guiding groove 101, but the wider fixing bar 200 may only enter the first guiding groove 100. In this way, the plugging direction of the second connector 2A is limited, that is, the wider fixing bar is plugged into the wider guiding groove, and the narrower fixing bar is plugged into the narrower guiding groove. Therefore, fool-proof effect may be achieved by the first guiding groove 100 and the second guiding groove 101 with different widths, so as to avoid the problem that the connection port 11 may not work or even be damaged due to the wrong plugging direction.

As mentioned above, the fool-proof design of the present disclosure is not limited to the first guiding groove 100 and the second guiding groove 101 with different widths. For example, in some embodiments, the first guiding groove 100 may have a first depth H1, and the second guiding groove 101 may have a second depth H2. The first depth H1 is different from the second depth H2. The thicker fixing bar 200 may correspond to the first guiding groove 100, and the thinner fixing bar 200 may correspond to the second guiding groove 101. When the second connector 2A is plugging into the first connector 1, even the thinner fixing bar 200 may enter the first guiding groove 100 and the second guiding groove 101, but the thicker fixing bar 200 may only enter the first guiding groove 100. As a result, the plugging direction of the second connector 2A is limited, that is, the thicker guiding bar is plugged into the thicker guiding groove, and the thinner guiding bar is plugged into the thinner guiding groove. Therefore, fool-proof effect may be achieved by the first guiding groove 100 and the second guiding groove 101 with different depths, so as to avoid the problem that the connection port 11 may not work or even be damaged due to the wrong plugging direction.

In some embodiments, the first width W1 of the first guiding groove 100 may be different from the second width W2 of the second guiding groove 101, and the first depth H1 of the first guiding groove 100 may be different from the second depth H2 of the second guiding groove 101. In this way, when the second connector 2A is plugged into the first connector 1, fool-proof effect will be more significant.

Figure 6:
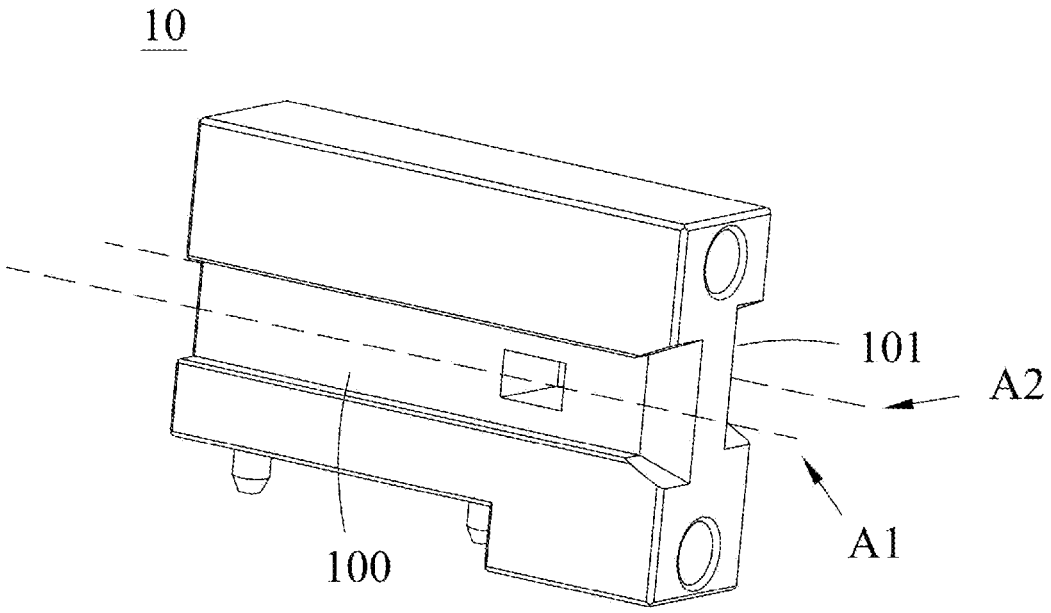
FIG. 6 is a space diagram of the guiding block according to another embodiment of the present disclosure.

FIG. 6 is a space diagram of the guiding block according to another embodiment of the present disclosure. As shown in the figure, in some embodiments, the axes of the first guiding groove 100 and the second guiding groove 101 may be located on different horizontal planes. Specifically, the depth and width of the first guiding groove 100 and the second guiding groove 101 are the same, but the axis A1 of the first guiding groove 100 and the axis A2 of the second guiding groove 101 are respectively located on different horizontal planes. That is, the distance between the axis A1 and the bottom surface of the guiding block 10 is different from the distance between the axis A2 and the bottom surface of the guiding block 10. Correspondingly, the axes of the two fixing bars 200 of the second connector 2A are also located on different horizontal planes. In this way, fool-proof effect may be achieved by the first guiding groove 100 and the second guiding groove 101 with axes located on different horizontal planes, so as to avoid the problem that the connection port 11 may not work or even be damaged due to the wrong plugging direction. In this embodiment, the first guiding groove 100 and the second guiding groove 101 partially overlap on the vertical plane. That is, the horizontal projection of the first guiding groove 100 and the horizontal projection of the second guiding groove 101 partial overlap, and the engaging hole 1000 passes through the overlapping part of the first guiding groove 100 and the second guiding groove 101.

Figure 7:
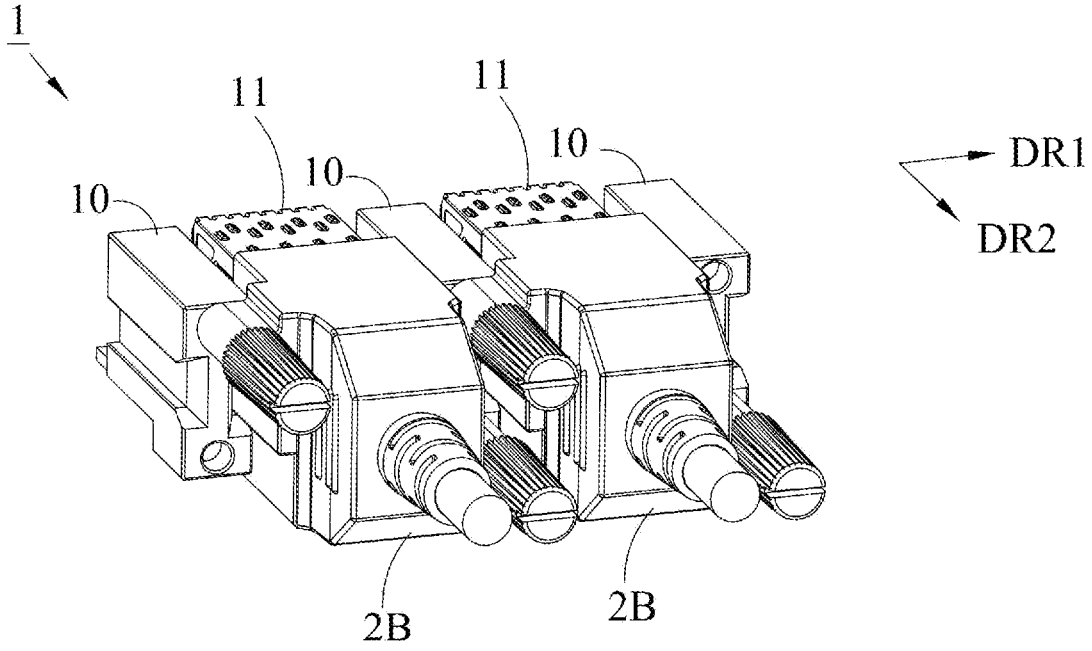
FIG. 7 is a schematic diagram of the first connector according to a yet embodiment of the present disclosure.
Figure 8:
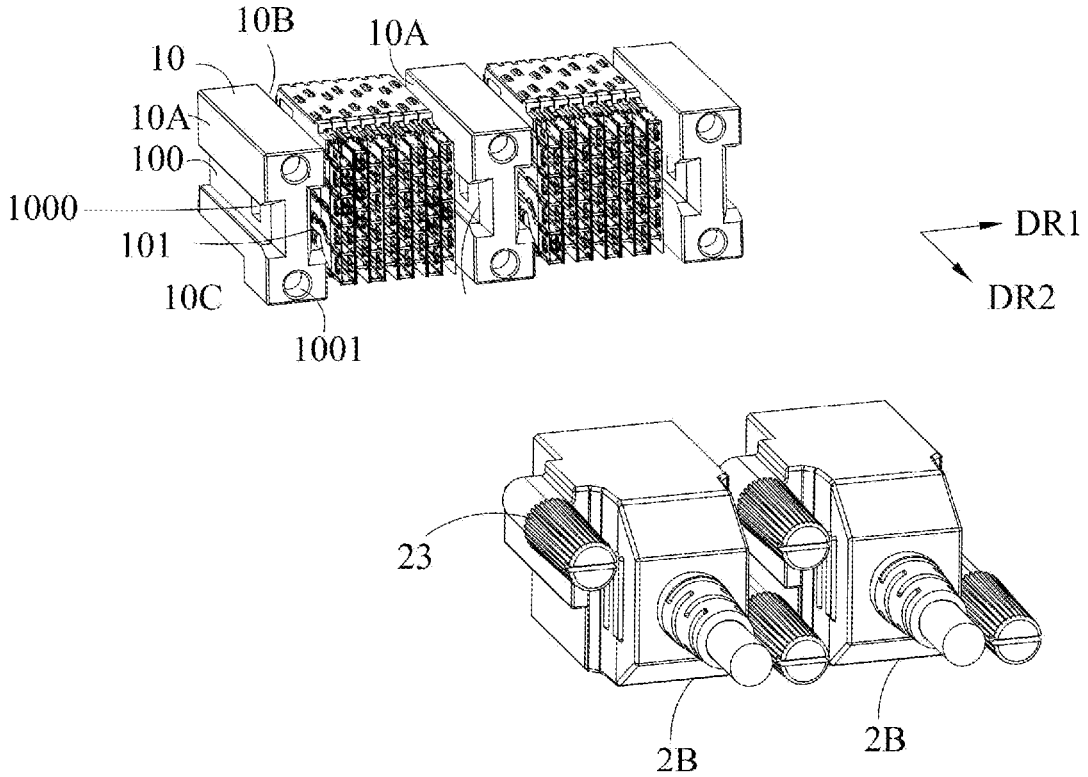
FIG. 8 is an exploded diagram of the first connector according to a yet embodiment of the present disclosure.

FIG. 7 and FIG. 8 are a schematic diagram and an exploded diagram of a connector according to a yet embodiment of the present disclosure. As shown in the figure, the connector (hereinafter referred to as the first connector 1) is used to connect the transmission end of the transmission line (hereinafter referred to as the second connector 2B). In this embodiment, the same reference numerals indicate similar or the same elements. Therefore, the detailed descriptions of similar or the same elements will be omitted. Compared with the embodiment mentioned above, the fixing method of the second connector 2B is different from the second connector 2A. More specifically, the second connector 2A is connected to the first connector 1 by engaging, and the second connector 2B is connected to the first connector 1 by screwing. In order to make the technical features of the present disclosure more obvious, the relationship between the locking hole 1001 and the second connector 2B will be described in detail hereinafter.

Figure 9:
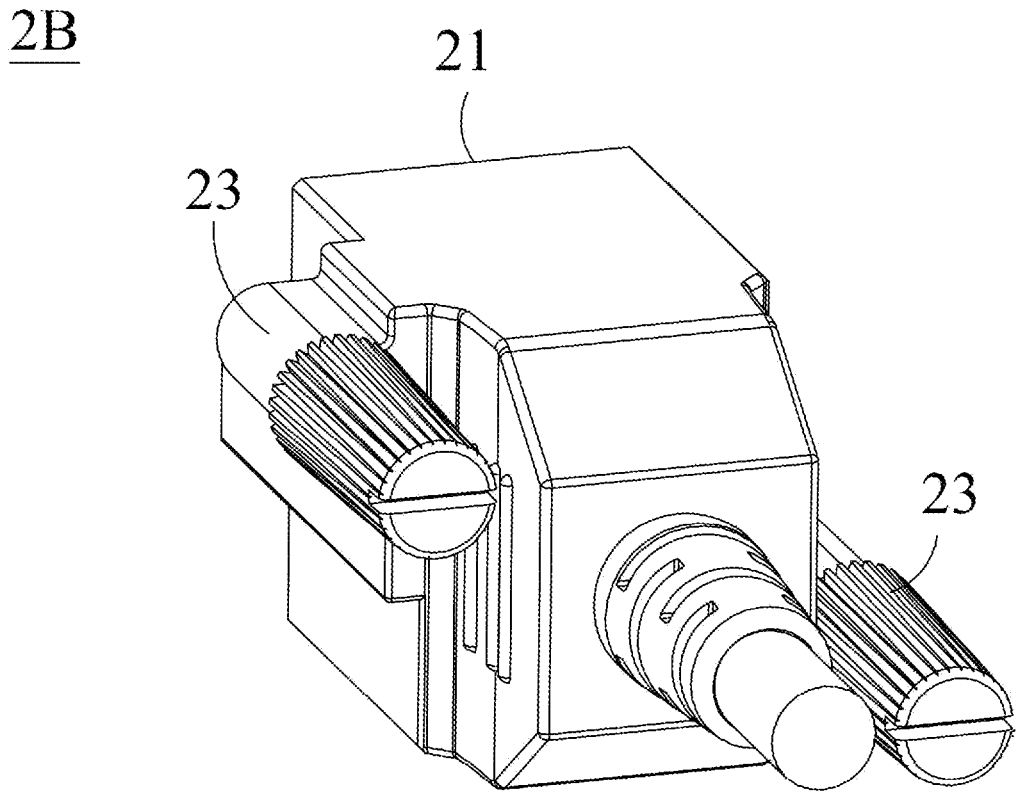
FIG. 9 is a schematic diagram of the second connector of the transmission line according to a yet embodiment of the present disclosure.

FIG. 9 is a schematic diagram of a transmission plug of a transmission line according to a yet embodiment of the present disclosure. As shown in the figure, the second connector 2B may include two locking pieces 23, and the two locking pieces 23 correspond to the locking hole 1001 on the first connector 1. The two locking pieces 23 are respectively disposed on both sides of the transmission port 21. Furthermore, from FIG. 9, one of the two locking pieces 23 is far away from the bottom surface of the second connector 2B, and the other of the two locking pieces 23 is close to the bottom surface of the second connector 2B. That is, the two locking pieces 23 are located on different horizontal planes. However, the present disclosure is not limited thereto. In other embodiments, the two locking pieces 23 may both be located on the same horizontal plane. For example, both of the two locking pieces 23 are located far away from the bottom surface of the second connector 2B, or both of the two locking pieces 23 are located close to the bottom surface of the second connector 2B.

Refer to FIG. 8 again. As mentioned above, in order to correspond to the two locking pieces 23 on different horizontal planes, therefore, in some embodiments, the locking hole 1001 may include a plurality of sub-locking holes 1001. For example, the number of the plurality of sub-locking holes 1001 is two. Further, two sub-locking holes 1001 are respectively disposed on both sides of the third surface 10C of the guiding block 10, and the two sub-locking holes 1001 respectively correspond to the two locking pieces 23 of the second connector 2B. In this way, the first connector 1 and the second connector 2B may be fixed by the two sub-locking holes 1001 and the two locking pieces 23.

In some embodiments, the shapes and/or sizes of the plurality of sub-locking holes 1001 are different. For example, the number of the plurality of sub-locking holes 1001 is two. The two sub-locking holes 1001 are respectively disposed at both ends of the third surface 10C of the guiding block 10, and the two sub-locking hole 1001 respectively correspond to the two locking pieces 23 of the second connector 2B. One of the two sub-locking holes 1001 is a circle with a larger diameter, and the other of the two sub-locking holes 1001 is a circle with a smaller diameter. One of the two locking pieces 23 corresponds to the larger locking hole 1001, and one of the two locking pieces 23 corresponds to the smaller locking hole 1001. In this way, the plugging direction of the second connector 2B is limited, therefore fool-proof effect is achieved. Furthermore, the problem that the connection port 11 may not work or even be damaged due to the wrong plugging direction may be also avoided by the locking hole 1001 of different sizes.

It should be noted that the above-mentioned design method is only an example. Fool-proof effect may be also achieved by the locking holes 1001 with different shapes of the connector 1 of the present disclosure. For example, one of the two sub-locking holes 1001 is circular, and the other of the two sub-locking holes 1001 is oval. Therefore, one of the two locking pieces 23 corresponds to the circular locking hole 1001, and one of the two locking pieces 23 corresponds to the oval locking hole 1001. In this way, the plugging direction of the second connector 2B is also limited, therefore fool-proof effect may be also achieved.

In practical applications, the first connector 1 of the present disclosure may be applied in the field of computers. For example, the connector assembly in a computer may include a circuit board, a first connector 1, and a second connector 2A. The first connector 1 is electrically connected to the circuit board. The second connector 2A is detachably connected to one of the at least one connection port 11 in the first connector 1, therefore the second connector 2A is electrically connected to the circuit board. The detailed connection method may be as described in the above embodiment, so it will be omitted. That is, the second connector 2A may be connected to the first connector 1 by engaging, and the functions of quick plugging and fool-proof are achieved.

In the other embodiment, the connector assembly in the computer may include a circuit board, the first connector 1, and the second connector 2B. The first connector 1 is electrically connected to the circuit board. The second connector 2B is detachably connected to one of the at least one connection port 11 in the first connector 1, therefore the second connector 2B is electrically connected to the circuit board. The detailed connection method may be as described in the above embodiment, so it will be omitted. That is, the second connector 2B may be connected to the first connector 1 by a screw locking method, and the functions of quick plugging and fool-proof may be achieved.

In summary, the plugging process of a transmission end may be smooth through the first guide groove and the second guide groove on the guiding block of the connector. In addition, one connection port of the connector may correspond to the transmission end having different fixing methods through an engaging hole and a lock hole, therefore the utilization of space is improved. Further, the number of connection ports with the same function but with different fixing methods of a product may be reduced by having the connector mentioned above, therefore the utilization of space is improved.

A person of ordinary skill in the art will understand current and future manufacturing processes, method and step from the content disclosed in some embodiments of the present disclosure, as long as the current or future manufacturing processes, method, and step performs substantially the same functions or obtain substantially the same results as the present disclosure. Therefore, the scope of the present disclosure includes the above-mentioned manufacturing process, method, and steps.

The above descriptions are only examples of this application and are not intended to limit this application. This disclosure may have various modifications and changes for a person of ordinary skill in the art. Any modification, equivalent replacement, improvement, etc. made within the spirit and principle of this application shall be included in the scope of the claims of this disclosure.

What is claimed is:

1. A connector, comprising:

a plurality of guiding blocks, wherein each of the plurality of guiding blocks has a first surface, a second surface opposite to the first surface, and a third surface adjacent to the first surface and the second surface, a first guiding groove is disposed on the first surface, a second guiding groove is disposed on the second surface, an engaging hole is inserted between the first guiding groove and the second guiding groove, and a locking hole is disposed on the third surface; and at least one connection port, wherein each of the at least one connection port is disposed on two adjacent guiding blocks of the plurality of guiding blocks, and one side of each of the at least one connection port faces the first surface of one of the plurality of guiding blocks, the other side of each of the at least one connection port faces the second surface of another of the plurality of guiding blocks.

2. The connector according to claim 1, wherein the first guiding groove has a first width, the second guiding groove has a second width, and the first width is different from the second width.

3. The connector according to claim 1, wherein the first guiding groove has a first depth, the second guiding groove has a second depth, and the first depth is different from the second depth.

4. The connector according to claim 1, wherein an axis of the first guiding groove and an axis of the second guiding groove are located on different horizontal planes.

5. The connector according to claim 1, wherein the locking hole comprises a plurality of sub-locking holes.

6. The connector according to claim 5, wherein the plurality of sub-locking holes have different shapes and/or sizes.

7. A connector assembly, comprising:

a circuit board;

a first connector electrically connected to the circuit board, wherein the first connector comprises:

a plurality of guiding blocks, wherein each of the plurality of guiding blocks has a first surface, a second surface opposite to the first surface, and a third surface adjacent to the first surface and the second surface, a first guiding groove is disposed on the first surface, a second guiding groove is disposed on the second surface, an engaging hole is inserted between the first guiding groove and the second guiding groove, and a locking hole is disposed on the third surface; and at least one connection port, wherein each of the at least one connection port is disposed on two adjacent guiding blocks of the plurality of guiding blocks, and one side of each of the at least one connection port faces the first surface of one of the plurality of guiding blocks, the other side of each of the at least one connection port faces the second surface of another of the plurality of guiding blocks; and a second connector detachably connected to one of the at least one connection port of the first connector, wherein the second connector comprises a fixing piece, the fixing piece has two fixing bars, the two fixing bars are respectively located on both sides of the fixing piece, and the two fixing bars respectively correspond to the first guiding groove and the second guiding groove.

8. The connector assembly according to claim 7, wherein the two fixing bars respectively comprise an engaging part.

9. A connector assembly, comprising:

a circuit board;

a first connector electrically connected to the circuit board, wherein the first connector comprises:

a plurality of guiding blocks, wherein each of the plurality of guiding blocks has a first surface, a second surface opposite to the first surface, and a third surface adjacent to the first surface and the second surface, a first guiding groove is disposed on the first surface, a second guiding groove is disposed on the second surface, an engaging hole is inserted between the first guiding groove and the second guiding groove, and a locking hole is disposed on the third surface; and at least one connection port, wherein each of the at least one connection port is disposed on two adjacent guiding blocks of the plurality of guiding blocks, and one side of each of the at least one connection port faces the first surface of one of the plurality of guiding blocks, the other side of each of the at least one connection port faces the second surface of another of the plurality of guiding blocks; and a second connector detachably connected to one of the at least one connection port of the first connector, wherein the second connector comprises at least two locking pieces, the at least two locking pieces are respectively located on both sides of the second connector, and the at least two locking pieces respectively correspond to the locking hole.

10. The connector assembly according to claim 7, wherein the at least two locking pieces are located on different horizontal planes.

* * * * *